US012516598B2

(12) United States Patent
Jandhyala et al.

(10) Patent No.: US 12,516,598 B2
(45) Date of Patent: Jan. 6, 2026

(54) METHOD TO DETERMINE CEMENT SHEATH FAILURE RISK UNDER CYCLIC LOADS USING REAL-TIME DOWNHOLE DEFORMATION DATA

(71) Applicant: Halliburton Energy Services, Inc., Houston, TX (US)

(72) Inventors: Siva Rama Krishna Jandhyala, Houston, TX (US); Giorgio DeVera, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/678,565

(22) Filed: May 30, 2024

(65) Prior Publication Data

US 2025/0369338 A1 Dec. 4, 2025

(51) Int. Cl.

| | |
|---|---|
| ***E21B 43/26*** | (2006.01) |
| ***E21B 21/08*** | (2006.01) |
| ***E21B 47/005*** | (2012.01) |

(52) U.S. Cl.

CPC ..... *E21B 47/005* (2020.05); *E21B 21/08* (2013.01); *E21B 43/26* (2013.01); *E21B 2200/20* (2020.05)

(58) Field of Classification Search

CPC ..... E21B 47/005; E21B 21/08; E21B 43/26; E21B 2200/20; E21B 47/00; E21B 49/00; C09K 8/46; G06F 30/20

(Continued)

(56) References Cited

U.S. PATENT DOCUMENTS

| | | | | |
|---|---|---|---|---|
| 10,465,505 | B2 | 11/2019 | Disko et al. | |
| 2009/0205819 | A1* | 8/2009 | Dale | E21B 49/00 166/305.1 |

(Continued)

FOREIGN PATENT DOCUMENTS

| | | |
|---|---|---|
| CN | 103967428 B | 1/2016 |
| CN | 109322661 A | 2/2019 |
| CN | 108733895 B | 5/2022 |

OTHER PUBLICATIONS

International Search Report and Written Opinion for International Patent Application No. PCT/US2024/035181 dated Feb. 14, 2025. PDF file. 8 pages.

(Continued)

*Primary Examiner* — Nicole Coy
*Assistant Examiner* — Douglas S Wood
(74) *Attorney, Agent, or Firm* — Thomas Rooney; C. Tumey Law Group PLLC

(57) ABSTRACT

A method of performing a wellbore servicing operation may include: obtaining a measurement of steady state creep rate ($\dot{\varepsilon}_{ss}$) within a cement sheath associated with a wellbore while performing the wellbore servicing operation in the wellbore; determining a number of cycles to failure ($N_f$) of the cement sheath using a cement material fatigue model wherein the cement material fatigue model has an input of steady state creep rate ($\dot{\varepsilon}_{ss}$); adjusting at least one operational parameter of the wellbore servicing operation in response to the determined number of cycles to failure ($N_f$) to form adjusted operational parameters; and performing the wellbore B servicing operation at the adjusted operational parameters.

18 Claims, 4 Drawing Sheets

(58) Field of Classification Search
USPC ..... 166/250.14
See application file for complete search history.

(56) References Cited

U.S. PATENT DOCUMENTS

| | | | | |
|---|---|---|---|---|
| 2017/0183964 | A1* | 6/2017 | Jandhyala | E21B 49/003 |
| 2018/0058202 | A1* | 3/2018 | Disko | E21B 47/12 |
| 2021/0301652 | A1* | 9/2021 | Zhang | E21B 43/26 |
| 2021/0324258 | A1* | 10/2021 | Allen, III | C09K 8/514 |
| 2022/0034199 | A1* | 2/2022 | Ionkina | E21B 43/003 |
| 2023/0281355 | A1* | 9/2023 | Jandhyala | E21B 33/14<br>703/10 |

OTHER PUBLICATIONS

Yang, Heng, et al. "Failure Mechanism of Integrity of Cement Sheath under the Coupling Effect of Formation Creep and Temperature during the Operation of Salt Rock Gas Storage." Energies Journal, vol. 16, No. 20, Article 7089, Oct. 2023, pp. 1-17. PDF file. 17 pages.

"Experimental investigation on the triaxial fatigue behavior of plain concrete", Magazine of Concrete Research, 1996, 48,No. 176, Sep. 157-172.

"Concrete Damage under Fatigue Loading in Uniaxial Compression", ACI Materials Journal, Title No. 114-M21, Mar.-Apr. 2017.

* cited by examiner

METHOD TO DETERMINE CEMENT SHEATH FAILURE RISK UNDER CYCLIC LOADS USING REAL-TIME DOWNHOLE DEFORMATION DATA

BACKGROUND

Technological advances in well construction and completion have enabled economic recovery of trapped hydrocarbon. Examples of these technologies are multi-stage hydraulic fracturing, water alternating gas (WAG), and steam assisted gravity drainage (SAGD). These technologies exert repeated structural and/or thermal loads on wellbore materials, specifically casing and the cement sheath. The cyclic loads exerted on the cement sheath causes accumulation of fatigue creep which may lead to premature failure of the cement sheath. The probability of failure is increased when the magnitude of the cyclic loads is increased or when the number of cycles exceeds the design of the cement sheath due to operational conditions. Furthermore, the accumulation of fatigue creep is not evenly distributed throughout the cement sheath and some portions of the cement sheath, such as at a lateral kickoff point, may experience greater accumulation of fatigue creep as compared to other portions of the cement sheath.

The response of steel to cyclic loading has been studied and established casing design techniques exist to model the effect of cyclic loads. However, these techniques do not extend to cement sheaths, nor do they provide a real-time analysis of fatigue creep accumulation and number of cycles remaining to failure during a wellbore operation.

BRIEF DESCRIPTION OF THE DRAWINGS

These drawings illustrate certain aspects of some of the examples of the present disclosure and should not be used to limit or define the disclosure.

DETAILED DESCRIPTION

Figure 1A:
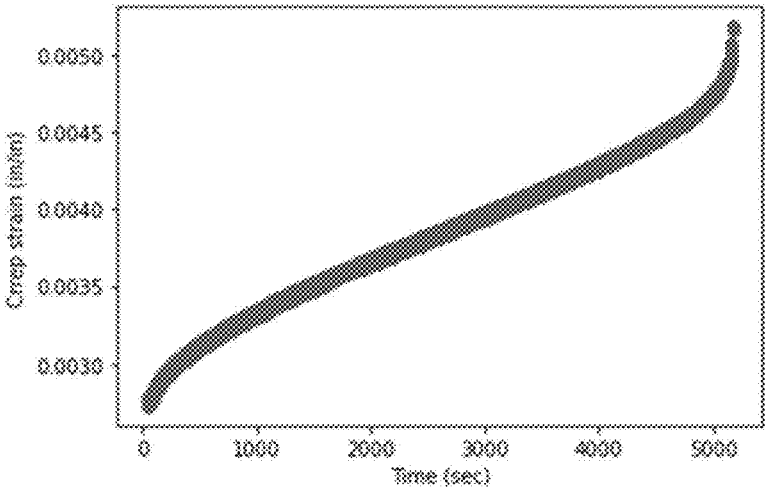
FIG. 1A is a graph of fatigue creep strain versus time, in accordance with examples of the present disclosure.

Methods of the present disclosure generally relate to using a real-time measurement of fatigue creep in a cement sheath as an input to a cement material fatigue model to calculate the remaining cycles a cement sheath can experience before failing. The methods disclosed herein allow for calculation of remaining pumping cycles before cement sheath failure at a localized point in the cement sheath for a given stress/ temperature. The real-time measurement of fatigue creep provides the necessary inputs to the cement material fatigue model and the cement material fatigue model in turn predicts the likelihood of cement sheath withstanding cyclic loads. The methods can be used with different forms of a cement material fatigue model. Further, the methods are applicable for a range of cyclic load curve shapes, frequencies, and stress levels. Cyclic load can be exerted by variations in temperature and/or pressure in the wellbore. The methods provide a quantitative assessment of the risk of damage to the cement sheath due to cyclic loads, thus reducing unwanted environmental impacts or need for remedial operations. Understating the quantitative effect of fatigue loading in cement sheath integrity aids in tailoring wellbore operations in real time in response to operational conditions. This allows operators to make informed adjustments to a wellbore operation which allows for increased operational efficiency because actual expected loading cycles are evaluated, and actual expected life may be accurately predicted.

Wellbore operations such as hydraulic fracturing, water alternating gas injection, and steam assisted gravity drainage, introduce cyclic fatigue in a wellbore cement sheath. The cyclic fatigue can be caused by pressure from a high-pressure fluid pumped into the wellbore and by thermal gradients caused by introducing a high-temperature fluid into the wellbore, optionally followed by a low-temperature fluids into the wellbore. The stress introduced into the cement sheath, either by a pressure gradient or a thermal gradient, causes deformation in the cement sheath leading to micro-cracks to form within the cement sheath. As the micro-cracks accrue over subsequent pumping cycles, the cement sheath becomes weakened until a failure plane appears through the cement sheath and the cement sheath can no longer perform the load-bearing function as designed. The magnitude of the strain is a function of the total stress introduced into the cement sheath where a lower stress generally leads to a lower strain and a higher stress generally leads to a higher strain. Thus, a fluid introduced into a wellbore at a relatively higher rate, relatively higher pressure, or relatively higher temperature will generally cause more deformation and micro-cracks than the same fluid introduced at a relatively lower rate, relatively lower pressure, or relatively lower temperature.

A wellbore design may include plans for several stages of hydraulic fracturing, where each stage of hydraulic fracturing is planned to have a rate and pressure for a particular fluid. As part of the wellbore design process, a cement composition is selected such that a cement sheath formed from the cement composition can withstand at least the minimum number of pumping cycles to complete each stage of hydraulic fracturing. However, when the hydraulic fracturing operation is performed, one or more operational parameters of the hydraulic fracturing operation may deviate from the wellbore design, thereby impacting the remaining number of pumping cycles the cement sheath can withstand. For example, a denser fluid at a higher rate than planned may be pumped thereby increasing the total stress introduced into the cement sheath and reducing the number of pumping cycles remaining before failure. Furthermore, operational changes to the hydraulic fracturing plan may have disparate impacts on the different parts of the cement sheath which experience higher stresses, such as kickoff portions. Thus, an operational change which induces higher stresses may reduce the number of pumping cycles a kickoff portion can withstand potentially leading to premature failure of the cement sheath before the hydraulic fracturing operation is completed.

In a first stage of the present methods, the fatigue creep strain or deformation creep in the cement sheath is obtained using a downhole sensing technique. In embodiments, the fatigue creep strain is measured using a fiber optic cable, a strain gauge, a piezo resistive sensor, an acoustic sensor, a sonic sensor, an ultrasonic sensor or any other suitable method for determining the fatigue creep in the cement sheath. The downhole sensing technique may return data such as shape of the load curve (e.g., sinusoidal, triangular), rate of loading in each cycle, lower and upper level of stress and/or temperature loading in each cycle. All of these variables may play a role in determining the steady state as well as maximum stress level experienced by the cement sheath. Depending on whether temperature load counteracts or magnifies pressure load, it is possible that the maximum deviatoric stress level, maximum tensile stress or maximum interfacial stress does not correspond to peak values of temperature and pressure. The maximum stress level itself is a function of geometry of the wellbore and the properties of the wellbore materials (e.g., cement sheath, casing, rock), and these are accounted for in the fatigue creep measurement in the first stage. In embodiments, the fatigue creep strain is measured over time. In embodiments, the fatigue creep strain is measured at one or more discrete locations within the cement sheath, along an interval of the cement sheath, and/or across the length of the cement sheath. In embodiments, the fatigue creep strain is measured at a point or an interval of interest, e.g. at a caprock and/or at a kickoff point. FIG. 1A is a graph of fatigue creep strain measurement versus time due to a constant stress for illustrative cement sheath. It can be observed that a cement sheath typically exhibits three phases of creep with a primary phase where the strain rate is a function of time, a secondary phase where the strain rate is constant, also referred to steady state creep rate ($\dot{\varepsilon}_{ss}$), and a tertiary phase the strain rate increases exponentially. In embodiments, the cement sheath experiences plastic strain in the steady state creep phase such that the cement sheath accumulates microcracks while in the steady state creep phase.

Figure 1B:
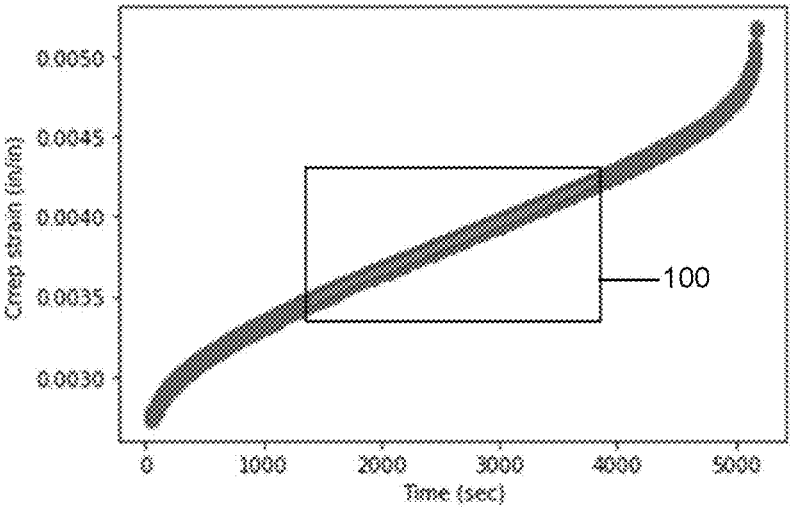
FIG. 1B is a graph of steady state creep rate ($\varepsilon_{ss}^{\bullet}$), in accordance with examples of the present disclosure.

In a second stage of the present methods, the steady state creep rate ($\dot{\varepsilon}_{ss}$) is extracted from the fatigue creep strain as measured by the downhole sensing technique. Box 100 in FIG. 1B illustrates extraction of the steady state creep rate ($\dot{\varepsilon}_{ss}$) which corresponds to the portion of the fatigue creep strain curve where the strain rate is constant.

In a third stage of the present methods, the steady state creep rate is passed as an input to a cement material fatigue model. The output from the cement material fatigue model is the number of cycles the cement sheath can withstand at the present stress level. The cement material fatigue model also has model parameters which correspond to the composition of the cement sheath. In embodiments, the cement material fatigue model has the form of Equation 1. Equation 1 is a power law form of the cement material fatigue model but other forms of the cement material fatigue model such as linear, polynomial, or exponential form may also be used.

$$N_f = A \times \dot{\varepsilon}_{ss}^{f(comp)} \qquad \text{Equation 1}$$

Where $N_f$ is total number of cycles to failure at the stress to failure, $\dot{\varepsilon}_{ss}$ is steady state creep rate measured by the downhole sensing technique, A is a model constant, and composition function $f$ (composition) is a function that determines the effect of composition on fatigue response of a cement.

In embodiments, the composition function $f$ (composition) is derived using a regression approach and includes significant variables which effect cement creep including water to pozzolan ratio water/pozzalon, concentration of elastomer in the cement, mass fraction of portland cement in the cement, weighting agent concentration either as a density increasing agent such as heavyweight or as a density reducing agent such as lightweight additives, as well as foam quality for foamed cements. In embodiments, the composition function $f$ (composition) has any suitable form including linear, polynomial, power law, or exponential form.

Figure 2:
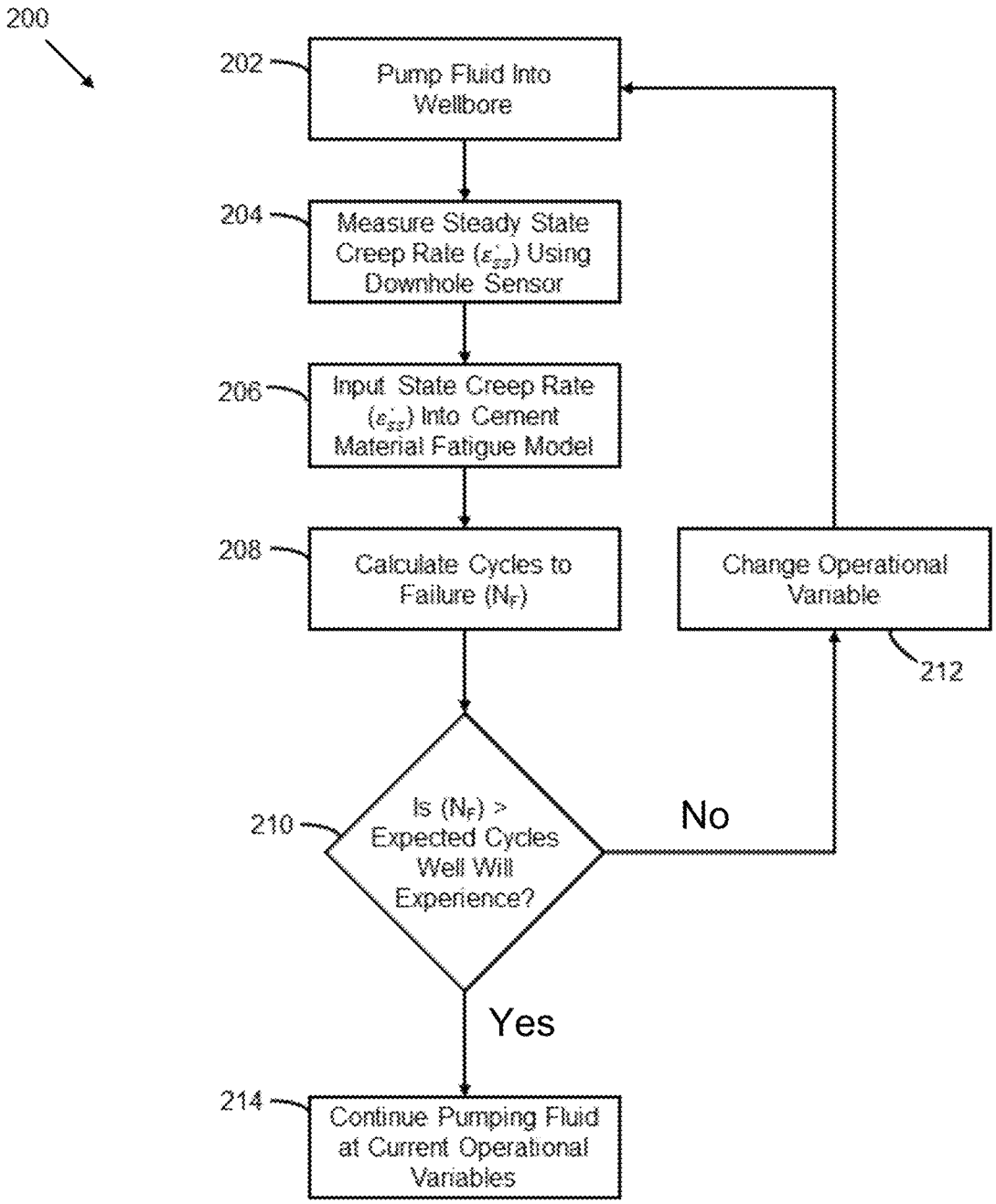
FIG. 2 illustrates a workflow for using a cement material fatigue model in a wellbore operation, in accordance with examples of the present disclosure.

FIG. 2 illustrates a workflow 200 for using a cement material fatigue model in a wellbore operation. Workflow 200 begins at block 202 where a wellbore servicing fluid is pumped into a wellbore during a wellbore servicing operation. Wellbore servicing operations include, but are not limited to, drilling operations, fracturing operations, perforating operations, acidizing operations, cementing operations, shut-in operations, production operations, injection operation, enhanced oil recovery operations, water and/or polymer flooding operations, and carbon dioxide injection operations. In embodiments, the wellbore servicing fluid includes introducing the wellbore servicing fluid at conditions suitable to carry out the intended function of the wellbore servicing fluid for the particular wellbore servicing operation. Wellbore servicing fluids correspond to the type of wellbore servicing operation which may include but are not limited to a fracturing fluid (e.g., a particle-laden fluid), a perforating fluid, a cementitious fluid, a sealant, a remedial fluid, a drilling fluid (e.g., mud), a spacer fluid, a gelation fluid, a polymeric fluid, an aqueous fluid, an oleaginous fluid, an emulsion, and various other wellbore servicing fluid. In embodiments, the wellbore servicing fluid is introduced at a density, a rate, a pressure, a temperature, or a combination thereof, such that the wellbore servicing fluid performs the servicing function as intended. In embodiments, a fracturing fluid is pumped into the wellbore at a designed density, rate, and at a pressure sufficient to create and extend at least one fracture within a subterranean formation penetrated by the wellbore, and the fracturing fluid contains a sufficient loading of proppant particles which suitably props open at least one fracture when the fracturing fluid pumping is stopped. In further embodiments, a water alternating gas operation includes pumping an aqueous based fluid into an injector wellbore at a designed rate and volume for a period of time followed by gas injection of carbon dioxide designed rate and volume for a period of time thereafter before alternating back to the aqueous based fluid to improve production at a producer wellbore. In embodiments, the wellbore operation includes introducing steam at a rate and pressure sufficient to increase hydrocarbon production. Several wellbore servicing operations such as steam assisted gravity drainage, cyclic steam stimulation "huff and puff", and high-pressure cyclic steam stimulation, for example, employ steam at a designed, temperature, rate and pressure sufficient to increase hydrocarbon production.

In block 204, a steady state creep rate ($\dot{\varepsilon}_{ss}$) is measured using a downhole sensor while the wellbore servicing fluid is pumped into the wellbore. In embodiments, the fatigue creep strain is measured using a fiber optic cable, a strain gauge, a piezo resistive sensor, a sonic sensor, an acoustic sensor, an ultrasonic sensor, or any other suitable method for determining the fatigue creep in the cement sheath. The steady state creep rate ($\dot{\varepsilon}_{ss}$) is extracted from the measured fatigue creep strain.

In block 206, the steady state creep rate ($\dot{\varepsilon}_{ss}$) from block 204 as well as the significant variables of cement composition input into the cement material fatigue model and in block 206 the number of cycles to failure $N_f$ is calculated. In embodiments, the significant variables of cement composition are known or retrieved from wellbore plans which include, for example, water to pozzolan ratio water/pozzalon, concentration of elastomer in the cement, mass fraction of portland cement in the cement, weighting agent concentration in the cement, foam quality for foamed cements, for example.

In condition block 208, the calculated number of cycles to failure $N_f$ calculated in block 206 is compared to the expected number of cycles which the wellbore will experience. The expected number of cycles may vary, but in some embodiments, the expected number of cycles may include a number of hydraulic fracturing stages in a hydraulic fracturing operation. In embodiments, the number of cycles may include the number of cycles of injection cycles of carbon dioxide in carbon dioxide disposal wells. In embodiments, the number of cycles includes the number of cycles of steam injection for enhanced oil recovery. In embodiments, the number of cycles includes a combination of the cycles from different wellbore servicing operations which have already been performed on the wellbore as well as the cycles from different wellbore servicing operations which are planned to be performed on the wellbore.

From condition block 208, if the calculated number of cycles to failure $N_f$ is fewer than the expected number of cycles, workflow 200 proceeds to block 212. In block 212 one or more operational parameter associated with the wellbore servicing operation are changed or adjusted to lower the stress experienced by the cement sheath. For example, one or more of rate, pressure, density, or temperature may be reduced to reduce the stress associated with pumping the wellbore servicing fluid. From block 212, workflow 200 proceeds back to block 202 and the wellbore servicing fluid is pumped at the new adjusted operational parameter selected in block 212. From condition block 208, if the calculated number of cycles to failure $N_f$ is more than the expected number of cycles, workflow 200 proceeds to block 214 and the wellbore servicing fluid is continued to be pumped according to the original operational parameter from block 202.

Figure 3:
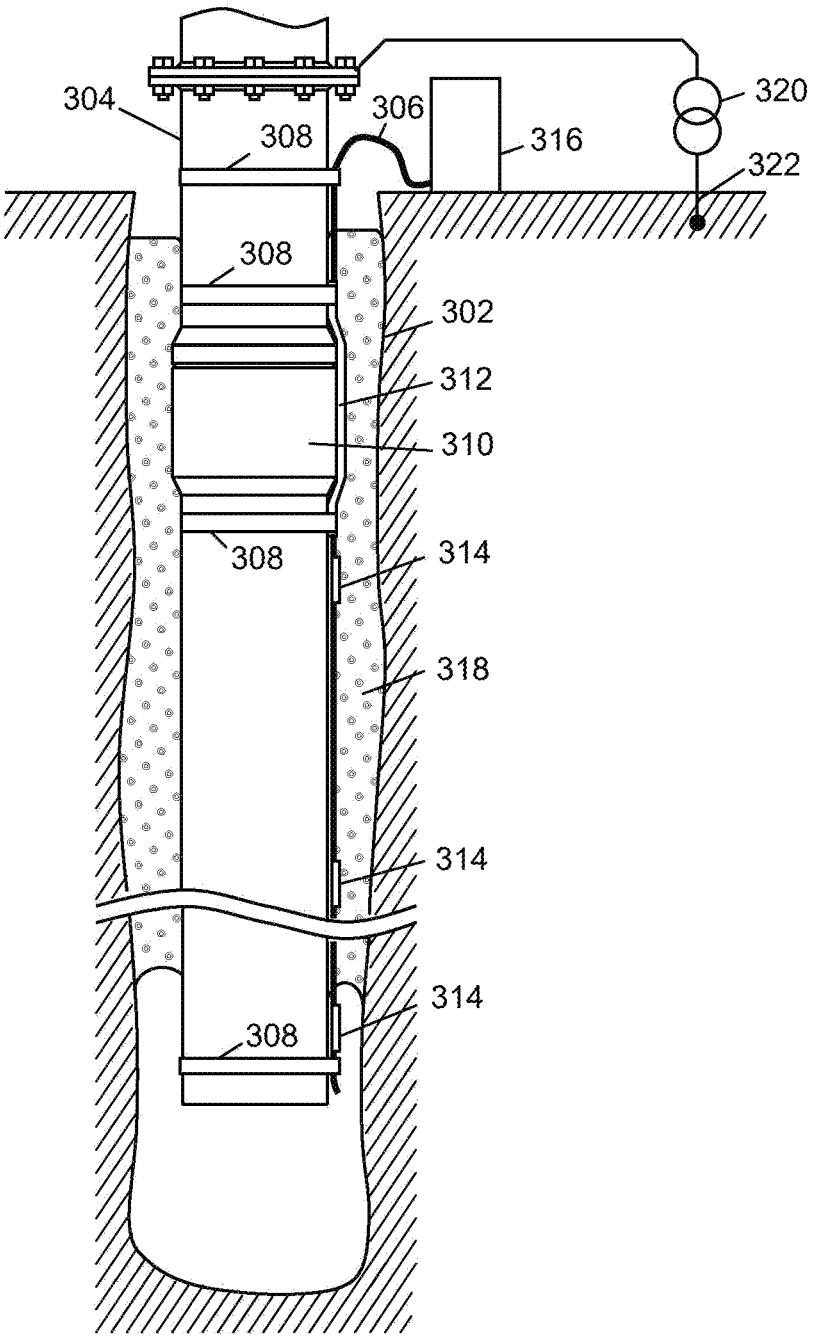
FIG. 3 shows an illustrative permanent downhole monitoring system suitable for determining steady state creep rate, in accordance with examples of the present disclosure.

FIG. 3 shows an illustrative permanent downhole monitoring system suitable for determining steady state creep rate ($\dot{\varepsilon}_{ss}$) for use with a cement material fatigue model described herein. A borehole 302 contains a casing 304 with a fiber optic cable 306 secured to it by bands 308. Where the fiber optic cable 306 passes over a casing joint 310, it may be protected from damage by a cable protector 312. Electromagnetic (EM) field sensors 314, including at least some distributed feedback fiber laser strain sensors, are integrated into the fiber optic cable 306 to obtain EM field measurements and communicate those measurements to a surface interface 316 via fiber optic cable 306.

The remaining annular space may be filled with cement 318 to secure the casing 304 in place and prevent fluid flows in the annular space. Fluid enters the uncemented portion of the well (or alternatively, fluid may enter through perforated portions of the well casing) and reaches the surface through the interior of the casing. Note that this well configuration is merely illustrative and not limiting on the scope of the disclosure. Many production wells are provided with multiple production zones that can be individually controlled. Similarly, many injection wells are provided with multiple injection zones that can be individually controlled.

Surface interface 316 includes an optical port for coupling the optical fiber(s) in fiber optic cable 306 to a light source and a detector. The light source transmits pulses of light along the fiber optic cable to excite sensors 314. The sensors 314 retransmit the energy as laser pulses to provide measurements of field strength, field gradient, or time derivative for electrical fields and/or magnetic fields. The frequency of the laser light pulses enable the detector to responsively produce an electrical output signal indicative of the sensor measurements. In some embodiments, the frequency shift caused by the distributed feedback fiber laser strain sensor is correlated with a measure of electrical field strength or gradient to determine strain within cement 318. For some monitoring systems, multiple fibers are employed, in which case an additional light source and detector can be employed for each fiber, or the existing source and detector may be switched periodically between the fibers.

FIG. 3 further shows a power source 320 coupled between the casing 304 and a remote earth electrode 322. Because the casing 304 is an electrically conductive material (e.g., steel), it acts as a source electrode for current flow into the formations surrounding the borehole 302. The magnitude and distribution of the current flow will vary in accordance with the source voltage and the formation's resistivity profile. The EM field measurements by sensors 314 will thus be representative of the resistivity profile. This resistivity profile in turn is indicative of the fluids in the formation pores, enabling the reservoir fluids to be tracked over time.

The surface interface 316 may be coupled to a computer that acts as a data acquisition system and possibly as a data processing system that analyzes the measurements to derive subsurface parameters such as stress within cement 318 and track the parameters over time. In embodiments, the computer is configured to calculate the steady state creep rate ($\dot{\varepsilon}_{ss}$) from the measurement of strain. The computer may utilize the steady state creep rate ($\dot{\varepsilon}_{ss}$) to calculate number of cycles remaining using a cement material fatigue model. In some contemplated system embodiments, the computer may further control equipment associated with a wellbore servicing operation. The computer may include the ability to control and adjust one or more operational parameter associated with the wellbore servicing equipment in response to the calculated cycles remaining. In embodiments, the operational parameter include the flow rate/pressure permitted into the wellbore, flow rate/pressure in selected injection zones, and the composition of the injection fluid including density, each of which can be controlled via computer controlled valves and pumps.

Generally, any such computer would be equipped with a user interface that enables a user to interact with the software via input devices such as keyboards, pointer devices, and touchscreens, and via output devices such as printers, monitors, and touchscreens. The software can reside in computer memory and on nontransient information storage media. The computer may be implemented in different forms including, e.g., an embedded computer permanently installed as part of the surface interface 316, a portable computer that is plugged into the surface interface 316 as desired to collect data, a remote desktop computer coupled to the surface interface 316 via a wireless link and/or a wired computer network.

Figure 4:
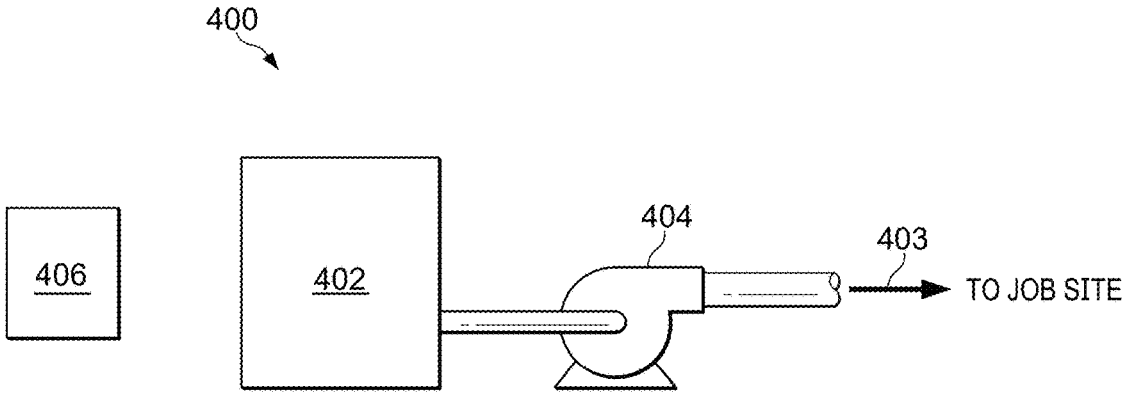
FIG. 4 illustrates a system for the preparation of a wellbore servicing fluid and subsequent delivery of the fluid to an application site, in accordance with examples of the present disclosure.

FIG. 4 illustrates a system 400 for the preparation of a wellbore servicing fluid and subsequent delivery of the fluid to an application site, in accordance with examples of the present disclosure. As shown, components of the wellbore servicing fluid may be mixed and/or stored in a vessel 402. The vessel 402 may be configured to contain and/or mix the components to produce or modify a wellbore servicing fluid 403 (e.g., a fracturing fluid, a cement, an enhanced oil recovery fluid). Non-limiting examples of the vessel 402 may include drums, barrels, tubs, bins, jet mixers, recirculating mixers, and/or batch mixers. The wellbore servicing fluid 403 may then be moved (e.g., pumped via pumping equipment 404) to a location.

The system 400 may also include a computer 406 for performing the workflow of FIG. 2 and to control wellbore servicing equipment. The computer 406 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. The computer 406 may be any processor-driven device, such as, but not limited to, a personal computer, laptop computer, smartphone, tablet, handheld computer, dedicated processing device, and/or an array of computing devices. In addition to having a processor, the computer 406 may include a server, a memory, input/output ("I/O") interface(s), and a network interface. The memory may be any computer-readable medium, coupled to the processor, such as RAM, ROM, and/or a removable storage device for storing data and a database management system ("DBMS") to facilitate management of data stored in memory and/or stored in separate databases.

The computer 406 may also include display devices such as a monitor featuring an operating system, media browser, and the ability to run one or more software applications. Additionally, the computer 406 may include non-transitory computer-readable media. Non-transitory computer-readable media may include any instrumentality or aggregation of instrumentalities that may retain data and/or instructions for a period of time.

Figure 5:
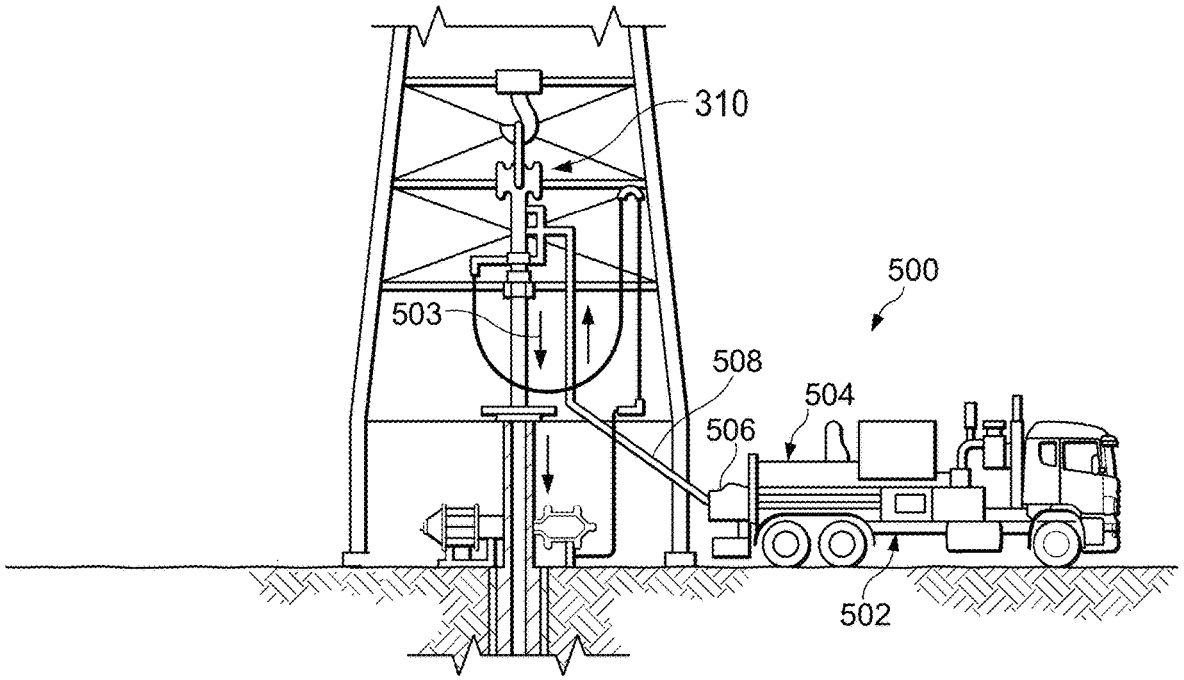
FIG. 5 illustrates a system to pump a wellbore servicing fluid during a wellbore servicing operation, in accordance with examples of the present disclosure.

FIG. 5 illustrates a system 500 that may be used to pump a wellbore servicing fluid during a wellbore servicing operation, in accordance with examples of the present disclosure. It should be noted that while FIG. 5 generally depicts a land-based operation, the principles described herein are equally applicable to subsea operations that employ floating or sea-based platforms and rigs, without departing from the scope of the disclosure.

The system 500 may include a pumping unit 502, which may include one or more pump trucks, for example. The pumping unit 502 may include mixing equipment 504 for preparing the wellbore servicing fluid and pumping equipment 506 for pumping the wellbore servicing fluid. The pumping unit 502 may pump the wellbore servicing fluid 503, through a feed pipe 508 and to a fluid conveyance 510 which conveys the wellbore servicing fluid 503 into a wellbore environment such as casing 304 in FIG. 3.

Cement slurries described herein may generally include a hydraulic cement and water. A variety of hydraulic cements may be utilized in accordance with the present disclosure, including, but not limited to, those comprising calcium, aluminum, silicon, oxygen, iron, and/or sulfur, which set and harden by reaction with water. Suitable hydraulic cements may include, but are not limited to, Portland cements, pozzolana cements, gypsum cements, high alumina content cements, silica cements, and any combination thereof. In certain examples, the hydraulic cement may include a Portland cement. In some examples, the Portland cements may include Portland cements that are classified as Classes A, C, H, and G cements according to American Petroleum Institute, *API Specification for Materials and Testing for Well Cements*, API Specification 10, Fifth Ed., Jul. 1, 1990. In addition, hydraulic cements may include cements classified by American Society for Testing and Materials (ASTM) in C150 (Standard Specification for Portland Cement), C595 (Standard Specification for Blended Hydraulic Cement) or C1157 (Performance Specification for Hydraulic Cements) such as those cements classified as ASTM Type I, II, or III. The hydraulic cement may be included in the cement slurry in any amount suitable for a particular composition. Without limitation, the hydraulic cement may be included in the cement slurries in an amount in the range of from about 10% to about 80% by weight of dry blend in the cement slurry. For example, the hydraulic cement may be present in an amount ranging between any of and/or including any of about 10%, about 15%, about 20%, about 25%, about 30%, about 35%, about 40%, about 45%, about 50%, about 55%, about 60%, about 65%, about 70%, about 75%, or about 80% by weight of the cement slurries.

The water may be from any source provided that it does not contain an excess of compounds that may undesirably affect other components in the cement slurries. For example, a cement slurry may include fresh water or saltwater. Saltwater generally may include one or more dissolved salts therein and may be saturated or unsaturated as desired for a particular application. Seawater or brines may be suitable for use in some examples. Further, the water may be present in an amount sufficient to form a pumpable slurry. In certain examples, the water may be present in the cement slurry in an amount in the range of from about 33% to about 200% by weight of the cementitious materials. For example, the water may be present in an amount ranging between any of and/or including any of about 33%, about 50%, about 75%, about 100%, about 125%, about 150%, about 175%, or about 200% by weight of the cementitious materials. The cementitious materials referenced may include all components which contribute to the compressive strength of the cement slurry such as the hydraulic cement and supplementary cementitious materials, for example.

As mentioned above, the cement slurry may include supplementary cementitious materials. The supplementary cementitious material may be any material that contributes to the desired properties of the cement slurry. Some supplementary cementitious materials may include, without limitation, fly ash, blast furnace slag, silica fume, pozzolans, kiln dust, and clays, for example.

The cement slurry may include kiln dust as a supplementary cementitious material. "Kiln dust," as that term is used herein, refers to a solid material generated as a by-product of the heating of certain materials in kilns. The term "kiln dust" as used herein is intended to include kiln dust made as described herein and equivalent forms of kiln dust. Depending on its source, kiln dust may exhibit cementitious properties in that it can set and harden in the presence of water. Examples of suitable kiln dusts include cement kiln dust, lime kiln dust, and combinations thereof. Cement kiln dust may be generated as a by-product of cement production that is removed from the gas stream and collected, for example, in a dust collector. Usually, large quantities of cement kiln dust are collected in the production of cement that are commonly disposed of as waste. The chemical analysis of the cement kiln dust from various cement manufactures varies depending on a number of factors, including the particular kiln feed, the efficiencies of the cement production operation, and the associated dust collection systems. Cement kiln dust generally may include a variety of oxides, such as $SiO_2$, $Al_2O_3$, $Fe_2O_3$, CaO, MgO, $SO_3$, $Na_2O$, and $K_2O$. The chemical analysis of lime kiln dust from various lime manufacturers varies depending on several factors, including the particular limestone or dolomitic limestone feed, the type of kiln, the mode of operation of the kiln, the efficiencies of the lime production operation, and the associated dust collection systems. Lime kiln dust generally may include varying amounts of free lime and free magnesium, lime stone, and/or dolomitic limestone and a variety of oxides, such as $SiO_2$, $Al_2O_3$, $Fe_2O_3$, CaO, MgO, $SO_3$, $Na_2O$, and $K_2O$, and other components, such as chlorides. A cement kiln dust may be added to the cement slurry prior to, concurrently with, or after activation. Cement kiln dust may include a partially calcined kiln feed which is removed from the gas stream and collected in a dust collector during the manufacture of cement. The chemical analysis of CKD from various cement manufactures varies depending on a number of factors, including the particular kiln feed, the efficiencies of the cement production operation, and the associated dust collection systems. CKD generally may comprise a variety of oxides, such as $SiO_2$, $Al_2O_3$, $Fe_2O_3$, CaO, MgO, $SO_3$, $Na_2O$, and $K_2O$. The CKD and/or lime kiln dust may be included in examples of the cement slurry in an amount suitable for a particular application.

In some examples, the cement slurry may further include one or more of slag, natural glass, shale, amorphous silica, or metakaolin as a supplementary cementitious material. Slag is generally a granulated, blast furnace by-product from the production of cast iron including the oxidized impurities found in iron ore. The cement may further include shale. A variety of shales may be suitable, including those including silicon, aluminum, calcium, and/or magnesium. Examples of suitable shales include vitrified shale and/or calcined shale. In some examples, the cement slurry may further include amorphous silica as a supplementary cementitious material.

Amorphous silica is a powder that may be included in embodiments to increase cement compressive strength. Amorphous silica is generally a byproduct of a ferrosilicon production process, wherein the amorphous silica may be formed by oxidation and condensation of gaseous silicon suboxide, SiO, which is formed as an intermediate during the process In some examples, the cement slurry may further include a variety of fly ashes as a supplementary cementitious material which may include fly ash classified as Class C, Class F, or Class N fly ash according to American Petroleum Institute, API Specification for Materials and Testing for Well Cements, API Specification 10, Fifth Ed., Jul. 1, 1990. In some examples, the cement slurry may further include zeolites as supplementary cementitious materials. Zeolites are generally porous alumino-silicate minerals that may be either natural or synthetic. Synthetic zeolites are based on the same type of structural cell as natural zeolites and may comprise aluminosilicate hydrates. As used herein, the term "zeolite" refers to all natural and synthetic forms of zeolite.

Where used, one or more of the aforementioned supplementary cementitious materials may be present in the cement slurry. For example, without limitation, one or more supplementary cementitious materials may be present in an amount of about 0.1% to about 80% by weight of the cement slurry. For example, the supplementary cementitious materials may be present in an amount ranging between any of and/or including any of about 0.1%, about 10%, about 20%, about 30%, about 40%, about 50%, about 60%, about 70%, or about 80% by weight of the cement.

In some examples, the cement slurry may further include hydrated lime. As used herein, the term "hydrated lime" will be understood to mean calcium hydroxide. In some embodiments, the hydrated lime may be provided as quicklime (calcium oxide) which hydrates when mixed with water to form the hydrated lime. The hydrated lime may be included in examples of the cement slurry, for example, to form a hydraulic composition with the supplementary cementitious components. For example, the hydrated lime may be included in a supplementary cementitious material-to-hydrated-lime weight ratio of about 10:1 to about 1:1 or 3:1 to about 5:1. Where present, the hydrated lime may be included in the set cement slurry in an amount in the range of from about 10% to about 100% by weight of the cement slurry, for example. In some examples, the hydrated lime may be present in an amount ranging between any of and/or including any of about 10%, about 20%, about 40%, about 60%, about 80%, or about 100% by weight of the cement slurry. In some examples, the cementitious components present in the cement slurry may consist essentially of one or more supplementary cementitious materials and the hydrated lime. For example, the cementitious components may primarily comprise the supplementary cementitious materials and the hydrated lime without any additional components (e.g., Portland cement, fly ash, slag cement) that hydraulically set in the presence of water.

Lime may be present in the cement slurry in several; forms, including as calcium oxide and or calcium hydroxide or as a reaction product such as when Portland cement reacts with water. Alternatively, lime may be included in the cement slurry by amount of silica in the cement slurry. A cement slurry may be designed to have a target lime to silica weight ratio. The target lime to silica ratio may be a molar ratio, molal ratio, or any other equivalent way of expressing a relative amount of silica to lime. Any suitable target time to silica weight ratio may be selected including from about 10/90 lime to silica by weight to about 40/60 lime to silica by weight. Alternatively, about 10/90 lime to silica by weight to about 20/80 lime to silica by weight, about 20/80 lime to silica by weight to about 30/70 lime to silica by weight, or about 30/70 lime to silica by weight to about 40/63 lime to silica by weight.

Other additives suitable for use in subterranean cementing operations also may be included in embodiments of the cement slurry. Examples of such additives include, but are not limited to: weighting agents, lightweight additives, gas-generating additives, mechanical-property-enhancing additives, lost-circulation materials, filtration-control additives, fluid-loss-control additives, defoaming agents, foaming agents, thixotropic additives, and combinations thereof. In embodiments, one or more of these additives may be added to the cement slurry after storing but prior to the placement of a cement slurry into a subterranean formation. In some examples, the cement slurry may further include a dispersant. Examples of suitable dispersants include, without limitation, sulfonated-formaldehyde-based dispersants (e.g., sulfonated acetone formaldehyde condensate) or polycarboxylated ether dispersants. In some examples, the dispersant may be included in the cement slurry in an amount in the range of from about 0.01% to about 5% by weight of the cementitious materials. In specific examples, the dispersant may be present in an amount ranging between any of and/or including any of about 0.01%, about 0.1%, about 0.5%, about 1%, about 2%, about 3%, about 4%, or about 5% by weight of the cementitious materials.

In some examples, the cement slurry may further include a set retarder. A broad variety of set retarders may be suitable for use in the cement slurries. For example, the set retarder may comprise phosphonic acids, such as ethylenediamine tetra(methylene phosphonic acid), diethylenetriamine penta (methylene phosphonic acid), etc.; lignosulfonates, such as sodium lignosulfonate, calcium lignosulfonate, etc.; salts such as stannous sulfate, lead acetate, monobasic calcium phosphate, organic acids, such as citric acid, tartaric acid, etc.; cellulose derivatives such as hydroxyl ethyl cellulose (HEC) and carboxymethyl hydroxyethyl cellulose (CMHEC); synthetic co- or ter-polymers comprising sulfonate and carboxylic acid groups such as sulfonate-functionalized acrylamide-acrylic acid co-polymers; borate compounds such as alkali borates, sodium metaborate, sodium tetraborate, potassium pentaborate; derivatives thereof, or mixtures thereof. Examples of suitable set retarders include, among others, phosphonic acid derivatives. Generally, the set retarder may be present in the cement slurry in an amount sufficient to delay the setting for a desired time. In some examples, the set retarder may be present in the cement slurry in an amount in the range of from about 0.01% to about 10% by weight of the cementitious materials. In specific examples, the set retarder may be present in an amount ranging between any of and/or including any of about 0.01%, about 0.1%, about 1%, about 2%, about 4%, about 6%, about 8%, or about 10% by weight of the cementitious materials.

In some examples, the cement slurry may further include an accelerator. A broad variety of accelerators may be suitable for use in the cement slurries. For example, the accelerator may include, but are not limited to, aluminum sulfate, alums, calcium chloride, calcium nitrate, calcium nitrite, calcium formate, calcium sulphoaluminate, calcium sulfate, gypsum-hemihydrate, sodium aluminate, sodium carbonate, sodium chloride, sodium silicate, sodium sulfate, ferric chloride, or a combination thereof. In some examples, the accelerators may be present in the cement slurry in an amount in the range of from about 0.01% to about 10% by weight of the cementitious materials. In specific examples, the accelerators may be present in an amount ranging between any of and/or including any of about 0.01%, about 0.1%, about 1%, about 2%, about 4%, about 6%, about 8%, or about 10% by weight of the cementitious materials.

Cement slurries generally should have a density suitable for a particular application. By way of example, the cement slurry may have a density in the range of from about 8 pounds per gallon ("ppg") (959 kg/m$^3$) to about 20 ppg (2397 kg/m$^3$), or about 8 ppg to about 12 ppg (1437. kg/m$^3$), or about 12 ppg to about 16 ppg (1917.22 kg/m$^3$), or about 16 ppg to about 20 ppg, or any ranges therebetween. Examples of the cement slurry may be foamed or unfoamed or may comprise other means to reduce their densities, such as hollow microspheres, low-density elastic beads, or other density-reducing additives known in the art.

The cement slurries disclosed herein may be used in a variety of subterranean applications, including primary and remedial cementing. The cement slurries may be introduced into a subterranean formation and allowed to set. In primary cementing applications, for example, the cement slurries may be introduced into the annular space between a conduit located in a wellbore and the walls of the wellbore (and/or a larger conduit in the wellbore), wherein the wellbore penetrates the subterranean formation. The cement slurry may be allowed to set in the annular space to form an annular sheath of hardened cement. The cement slurry may form a barrier that prevents the migration of fluids in the wellbore. The cement slurry may also, for example, support the conduit in the wellbore. In remedial cementing applications, the cement slurry may be used, for example, in squeeze cementing operations or in the placement of cement plugs. By way of example, the cement slurry may be placed in a wellbore to plug an opening (e.g., a void or crack) in the formation, in a gravel pack, in the conduit, in the cement sheath, and/or between the cement sheath and the conduit (e.g., a micro annulus).

Accordingly, the methods of the present disclosure analyze suitability of cement compositions for use in wells that may experience cyclic loads. The methods may include any of the various features disclosed herein, including one or more of the following statements.

Statement 1. A method of performing a wellbore servicing operation comprising: obtaining a measurement of steady state creep rate ($\dot{\varepsilon}_{ss}$) within a cement sheath associated with a wellbore while performing the wellbore servicing operation in the wellbore; determining a number of cycles to failure ($N_f$) of the cement sheath using a cement material fatigue model wherein the cement material fatigue model has an input of steady state creep rate ($\dot{\varepsilon}_{ss}$); adjusting at least one operational parameter of the wellbore servicing operation in response to the determined number of cycles to failure ($N_f$) to form adjusted operational parameters; and performing the wellbore servicing operation at the adjusted operational parameters.

Statement 2. The method of statement 1 wherein the wellbore servicing operation comprises at least one operation selected from the group consisting of a drilling operation, a fracturing operation, a perforating operation, an acidizing operation, a cementing operation, an enhanced oil recovery operation, a water flooding operation, a polymer flooding operation, a carbon dioxide injection operation, and combinations thereof.

Statement 3. The method of any of statements 1-2 wherein the wellbore servicing operation includes introducing at least one servicing fluid selected from the group consisting of a fracturing fluid, a perforating fluid, a cementitious fluid, a sealant fluid, a remedial fluid, a drilling fluid, a spacer fluid, a gelation fluid, a polymeric fluid, an aqueous fluid, an oleaginous fluid, an emulsion fluid, and combinations thereof.

Statement 4. The method of any of statements 1-3 wherein the measurement of steady state creep rate ($\dot{\varepsilon}_{ss}$) is obtained using a downhole sensing technique selected from the group consisting of a fiber optic cable, a strain gauge, a piezo resistive sensor, an acoustic sensor, sonic sensor, ultrasonic sensor and combinations thereof.

Statement 5. The method of any of statements 1-4 wherein the cement material fatigue model has a linear form, a polynomial form, an exponential form, or any combination thereof.

Statement 6. The method of any of statements 1-5 wherein the cement material fatigue model has a form of: $N_f = A \times \dot{\varepsilon}_{ss}^{\,f(comp)}$ where $N_f$ is total number of cycles to failure, A is a model constant, and composition function $f$ (composition) is a function that determines an effect of composition on fatigue response of a cement.

Statement 7. The method of any of statements 1-6 wherein the cement material fatigue model has a linear form, a polynomial form, an exponential form, or any combination thereof.

Statement 8. The method of any of statements 1-6 wherein the cement material fatigue model is a function of at least one of water to pozzolan ratio water/pozzalon in the cement sheath, concentration of elastomer in the cement sheath, mass fraction of portland cement in the cement sheath, weighting agent concentration in the cement sheath, and foam quality in the cement sheath.

Statement 9. The method of any of statements 1-8 wherein adjusting at least one operational parameter reduces a stress exerted on the cement sheath.

Statement 10. The method of any of statements 1-9 wherein adjusting at least one operational parameter comprises adjusting at least one of a rate, a pressure, a density, a temperature, or a combination thereof of the wellbore servicing fluid.

Statement 11. A method of performing a wellbore servicing operation comprising: determining a remaining number of cycles for the wellbore servicing operation in a wellbore; obtaining a measurement of steady state creep rate ($\dot{\varepsilon}_{ss}$) within a cement sheath associated with the wellbore while pumping a wellbore servicing fluid into the wellbore; determining number of cycles to failure ($N_f$) of the cement sheath using a cement material fatigue model wherein the cement material fatigue model has an input of steady state creep rate ($\dot{\varepsilon}_{ss}$); comparing the number of cycles to failure and the remaining number of cycles; and adjusting at least one operational parameter of the wellbore servicing operation while such that the number of cycles to failure is greater than the remaining number of cycles.

Statement 12. The method of statement 11 wherein the wellbore servicing operation comprises at least one operation selected from the group consisting of a drilling operation, a fracturing operation, a perforating operation, an acidizing operation, a cementing operation, an enhanced oil recovery operation, a water flooding operation, a polymer flooding operation, a carbon dioxide injection operation, and combinations thereof.

Statement 13. The method of any of statements 11-12 wherein the wellbore servicing operation includes introducing at least one servicing fluid selected from the group consisting of a fracturing fluid, a perforating fluid, a cementitious fluid, a sealant fluid, a remedial fluid, a drilling fluid, a spacer fluid, a gelation fluid, a polymeric fluid, an aqueous fluid, an oleaginous fluid, an emulsion fluid, and combinations thereof.

Statement 14. The method of any of statements 11-13 wherein the measurement of steady state creep rate ($\dot{\varepsilon}_{ss}$) is obtained using a downhole sensing technique selected from the group consisting of a fiber optic cable, a strain gauge, a piezo resistive sensor, an acoustic sensor, a sonic sensor, an ultrasonic sensor, and combinations thereof.

Statement 15. The method of any of statements 11-14 wherein the cement material fatigue model has a form of: $N_f = A \times \dot{\varepsilon}_{ss}^{f(comp)}$ where $N_f$ is total number of cycles to failure, A is a model constant, and composition function $f$ (composition) is a function that determines an effect of composition on fatigue response of a cement.

Statement 16. The method of any of statements 11-15 wherein the cement material fatigue model is a function of at least one of water to pozzolan ratio water/pozzalon in the cement sheath, concentration of elastomer in the cement sheath, mass fraction of portland cement in the cement sheath, weighting agent concentration in the cement sheath, and foam quality in the cement sheath.

Statement 17. The method of statement 15 wherein the cement material fatigue model has a linear form, a polynomial form, an exponential form, or any combination thereof.

Statement 18. The method of any of statements 11-17 wherein adjusting at least one operational parameter reduces a stress exerted on the cement sheath.

Statement 19. The method of any of statements 11-18 wherein adjusting at least one operational parameter comprises adjusting at least one of a rate, a pressure, a density, a temperature, or a combination thereof of the wellbore servicing fluid.

Statement 20. A method of performing a wellbore servicing operation comprising: introducing a fracturing fluid into a wellbore penetrating a subterranean formation at a rate and a volume sufficient to create or extend at least one fracture within the subterranean formation, wherein the wellbore comprising a cement sheath; determining a remaining number of fracturing stages for the wellbore servicing operation; obtaining a measurement of steady state creep rate ($\dot{\varepsilon}_{ss}$) within the cement sheath while pumping the fracturing fluid; determining number of cycles to failure ($N_f$) of the cement sheath using a cement material fatigue model wherein the cement material fatigue model has an input of steady state creep rate ($\dot{\varepsilon}_{ss}$); comparing the number of cycles to failure and the remaining number of fracturing stages; and adjusting at least one of the rate or the volume of the fracturing fluid such that the number of cycles to failure is greater than the remaining number of fracturing stages while maintaining sufficient rate and volume to sustain creating or extending at least one fracture with in the subterranean formation.

To facilitate a better understanding of the present invention, the following examples of certain aspects of some embodiments are given. In no way should the following examples be read to limit, or define, the entire scope of the disclosure.

Examples

Figure 1C:
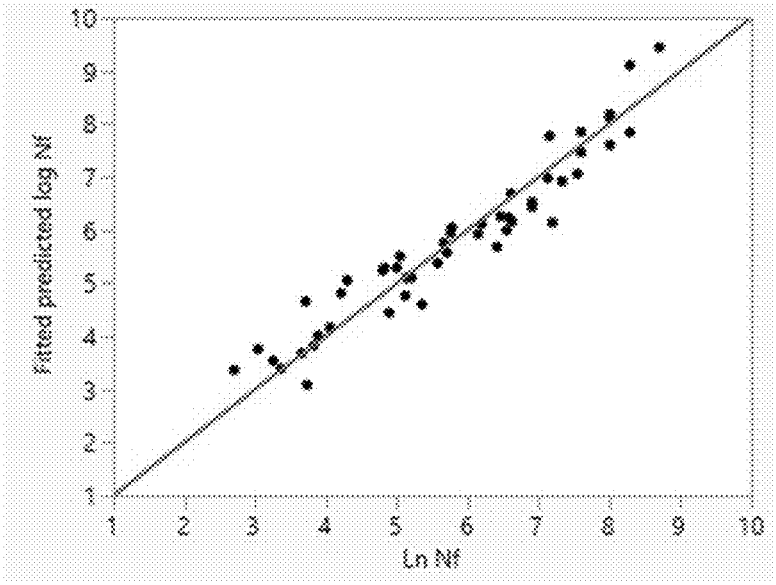
FIG. 1C is a parity plot of a cement material fatigue model, in accordance with examples of the present disclosure.

In this example, a cement material fatigue model which included a linear composition function $f$ (composition) was developed. Three cement systems were tested, a neat portland cement system, an elastomer modified portland cement system, and a pozzolanic cement system. Samples were prepared for each cement system and cured to form cured cement samples. Each of the cured cement samples were subjected to a determined stress level for a number of cycles in a load cell until the cement sample structurally failed. Multiple cured samples of the same cement system were subjected to each stress level to achieve a statistically significant measure of cycles at each stress level to failure. The data was fit to the cement model of Equation 1 using regression analysis where the linear composition function $f$ (composition) included variables of water to pozzolan ratio water/pozzalon, concentration of elastomer in the cement, mass fraction of portland cement in the cement, and weighting agent concentration. FIG. 1C is a parity plot of the fit model of Equation 1. It was observed that the model had a good predictivity for number of cycles to failure for all cement system types. The model constant A signifies the number of cycles to failure at a steady state creep rate of unity. At this unrealistically large rate, number of cycles to failure are extremely less (on the order of $1\times10^{-6}$) and are composition independent.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited as well as ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

What is claimed is:

1. A method of performing a wellbore servicing operation comprising:

obtaining a measurement of steady state creep rate ($\dot{\varepsilon}_{ss}$) within a cement sheath associated with a wellbore while performing the wellbore servicing operation in the wellbore using a wellbore servicing fluid;

determining a number of cycles to failure ($N_f$) of the cement sheath using a cement material fatigue model wherein the cement material fatigue model has an input of steady state creep rate ($\dot{\varepsilon}_{ss}$);

adjusting at least one of a rate, a pressure, a density, a temperature, or a combination thereof of the wellbore servicing fluid in response to the determined number of cycles to failure ($N_f$); and performing the wellbore servicing operation at the rate, the pressure, the density, the temperature, or a combination thereof.

2. The method of claim 1 wherein the wellbore servicing operation comprises at least one operation selected from the group consisting of a drilling operation, a fracturing operation, a perforating operation, an acidizing operation, a cementing operation, an enhanced oil recovery operation, a water flooding operation, a polymer flooding operation, a carbon dioxide injection operation, and combinations thereof.

3. The method of claim 1 wherein the wellbore servicing operation includes introducing at least one servicing fluid selected from the group consisting of a fracturing fluid, a perforating fluid, a cementitious fluid, a sealant fluid, a remedial fluid, a drilling fluid, a spacer fluid, a gelation fluid, a polymeric fluid, an aqueous fluid, an oleaginous fluid, an emulsion fluid, and combinations thereof.

4. The method of claim 1 wherein the measurement of steady state creep rate ($\dot{\varepsilon}_{ss}$) is obtained using a downhole sensing technique selected from the group consisting of a fiber optic cable, a strain gauge, a piezo resistive sensor, an acoustic sensor, sonic sensor, ultrasonic sensor and combinations thereof.

5. The method of claim 1 wherein the cement material fatigue model has a linear form, a polynomial form, an exponential form, or any combination thereof.

6. The method of claim 1 wherein the cement material fatigue model has a form of:

$$N_f = A \times \dot{\varepsilon}_{ss}^{f(comp)}$$

where $N_f$ is total number of cycles to failure, A is a model constant, and composition function $f$ (composition) is a function that determines an effect of composition on fatigue response of a cement.

7. The method of claim 6 wherein the cement material fatigue model has a linear form, a polynomial form, an exponential form, or any combination thereof.

8. The method of claim 6 wherein the cement material fatigue model is a function of at least one of water to pozzolan ratio water/pozzalon in the cement sheath, concentration of elastomer in the cement sheath, mass fraction of portland cement in the cement sheath, weighting agent concentration in the cement sheath, and foam quality in the cement sheath.

9. The method of claim 1 wherein adjusting at least one operational parameter reduces a stress exerted on the cement sheath.

10. A method of performing a wellbore servicing operation comprising:

determining a remaining number of cycles for the wellbore servicing operation in a wellbore;

obtaining a measurement of steady state creep rate ($\dot{\varepsilon}_{ss}$) within a cement sheath associated with the wellbore while pumping a wellbore servicing fluid into the wellbore;

determining number of cycles to failure ($N_f$) of the cement sheath using a cement material fatigue model wherein the cement material fatigue model has an input of steady state creep rate ($\dot{\varepsilon}_{ss}$);

comparing the number of cycles to failure and the remaining number of cycles; and adjusting at least one of a rate, a pressure, a density, a temperature, or a combination thereof of the wellbore servicing fluid such that the number of cycles to failure is greater than the remaining number of cycles.

11. The method of claim 10 wherein the wellbore servicing operation comprises at least one operation selected from the group consisting of a drilling operation, a fracturing operation, a perforating operation, an acidizing operation, a cementing operation, an enhanced oil recovery operation, a water flooding operation, a polymer flooding operation, a carbon dioxide injection operation, and combinations thereof.

12. The method of claim 10 wherein the wellbore servicing fluid comprises at least one fluid selected from the group consisting of a fracturing fluid, a perforating fluid, a cementitious fluid, a sealant fluid, a remedial fluid, a drilling fluid, a spacer fluid, a gelation fluid, a polymeric fluid, an aqueous fluid, an oleaginous fluid, an emulsion fluid, and combinations thereof.

13. The method of claim 10 wherein the measurement of steady state creep rate ($\dot{\varepsilon}_{ss}$) is obtained using a downhole sensing technique selected from the group consisting of a fiber optic cable, a strain gauge, a piezo resistive sensor, an acoustic sensor, a sonic sensor, an ultrasonic sensor, and combinations thereof.

14. The method of claim 10 wherein the cement material fatigue model has a form of:

$$N_f = A \times \dot{\varepsilon}_{ss}^{f(comp)}$$

where $N_f$ is total number of cycles to failure, A is a model constant, and composition function $f$ (composition) is a function that determines an effect of composition on fatigue response of a cement.

15. The method of claim 14 wherein the cement material fatigue model is a function of at least one of water to pozzolan ratio water/pozzalon in the cement sheath, concentration of elastomer in the cement sheath, mass fraction of portland cement in the cement sheath, weighting agent concentration in the cement sheath, and foam quality in the cement sheath.

16. The method of claim 14 wherein the cement material fatigue model has a linear form, a polynomial form, an exponential form, or any combination thereof.

17. The method of claim 10 wherein adjusting at least one operational parameter reduces a stress exerted on the cement sheath.

18. A method of performing a wellbore servicing operation comprising:

introducing a fracturing fluid into a wellbore penetrating a subterranean formation at a rate and a volume sufficient to create or extend at least one fracture within the subterranean formation, wherein the wellbore comprising a cement sheath;

determining a remaining number of fracturing stages for the wellbore servicing operation;

obtaining a measurement of steady state creep rate ($\dot{\varepsilon}_{ss}$) within the cement sheath while pumping the fracturing fluid;

determining number of cycles to failure ($N_f$) of the cement sheath using a cement material fatigue model wherein the cement material fatigue model has an input of steady state creep rate ($\dot{\varepsilon}_{ss}$);

comparing the number of cycles to failure and the remaining number of fracturing stages; and adjusting at least one of the rate or the volume of the fracturing fluid such that the number of cycles to failure is greater than the remaining number of fracturing stages while maintaining sufficient rate and volume to sustain creating or extending at least one fracture within the subterranean formation.

* * * * *